US011430401B2

(12) United States Patent
Wang

(10) Patent No.: US 11,430,401 B2
(45) Date of Patent: Aug. 30, 2022

(54) DRIVE CIRCUIT, DISPLAY MODULE DRIVING METHOD AND DISPLAY MODULE

(71) Applicant: HKC CORPORATION LIMITED, Shenzhen (CN)

(72) Inventor: Mingliang Wang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 741 days.

(21) Appl. No.: 16/331,150

(22) PCT Filed: Nov. 13, 2018

(86) PCT No.: PCT/CN2018/115210

§ 371 (c)(1),
(2) Date: Mar. 7, 2019

(87) PCT Pub. No.: WO2020/087569

PCT Pub. Date: May 7, 2020

(65) Prior Publication Data

US 2021/0350758 A1 Nov. 11, 2021

(30) Foreign Application Priority Data

Oct. 31, 2018 (CN) ..... 201811282987.5

(51) Int. Cl.

| | |
|---|---|
| ***G09G 3/36*** | (2006.01) |
| ***G09G 3/3266*** | (2016.01) |
| ***G09G 3/34*** | (2006.01) |
| ***G09G 5/18*** | (2006.01) |

(52) U.S. Cl.

CPC ..... *G09G 3/3677* (2013.01); *G09G 3/3266* (2013.01); *G09G 3/3406* (2013.01); *G09G 5/18* (2013.01); *G09G 2310/08* (2013.01); *G09G 2320/0252* (2013.01); *G09G 2330/026* (2013.01)

(58) Field of Classification Search

CPC ..... G09G 2310/08; G09G 2310/0243; G09G 3/3266; G09G 3/3677; G09G 3/2092; G09G 3/3688; G09G 3/3696; G09G 3/20; G09G 2330/021; G09G 2330/02; G09G 2330/026; G09G 2330/028; G09G 2320/0693; G09G 3/3406; G09G 3/3258; G09G 3/3648; G09G 2320/0646; G09G 2320/0252; G09G 5/18

See application file for complete search history.

(56) References Cited

U.S. PATENT DOCUMENTS

| | | | | |
|---|---|---|---|---|
| 9,401,105 | B2 * | 7/2016 | Cho | G09G 5/18 |
| 10,283,065 | B2 * | 5/2019 | Lee | G09G 3/2096 |
| 10,360,836 | B2 * | 7/2019 | Chen | G09G 3/3607 |
| 10,923,067 | B2 * | 2/2021 | Lee | G09G 3/3688 |
| 2006/0125760 | A1 * | 6/2006 | Jee | G09G 3/20 345/98 |
| 2011/0199397 | A1 * | 8/2011 | Ko | G09G 3/3688 345/690 |

(Continued)

*Primary Examiner* — Dismery Mercedes

(57) ABSTRACT

The present application discloses a drive circuit, a display module driving method and a display module. The drive circuit includes: a timing control chip, configured to output a state signal; a control circuit, configured to receive the state signal and output a ready signal; and a gate drive circuit, configured to control, according to the ready signal, whether a display screen displays a picture or not.

13 Claims, 3 Drawing Sheets

(56) References Cited

U.S. PATENT DOCUMENTS

| | | | | |
|---|---|---|---|---|
| 2012/0056870 | A1* | 3/2012 | Koh | G09G 3/20 345/215 |
| 2014/0210700 | A1* | 7/2014 | Won | G09G 3/3677 345/102 |
| 2014/0240307 | A1* | 8/2014 | Chen | G09G 3/3696 327/108 |
| 2014/0306948 | A1* | 10/2014 | Iwamoto | G09G 3/3677 345/99 |
| 2018/0114508 | A1* | 4/2018 | Cho | G06F 3/1446 |
| 2019/0180709 | A1* | 6/2019 | Lee | G09G 3/20 |
| 2020/0013341 | A1* | 1/2020 | Kim | G09G 3/3266 |

* cited by examiner

DRIVE CIRCUIT, DISPLAY MODULE DRIVING METHOD AND DISPLAY MODULE

The present application claims priority to the Chinese Patent Application No. CN201811282987.5, filed to National Intellectual Property Administration, PRC on Oct. 31, 2018, and entitled "DRIVE CIRCUIT, DISPLAY MODULE DRIVING METHOD AND DISPLAY MODULE", which is incorporated herein by reference in its entirety.

TECHNICAL FIELD

The present application relates to the technical field of display, and in particular to a drive circuit, a display module driving method and a display module.

BACKGROUND

The statements in this section merely provide background information related to the present application and may not constitute prior art.

Along with the development and progress of science and technology, a. Liquid Crystal Display (LCD) has become a mainstream display product and is widely applied because of hot points such as a thin body, power saving and low radiation. It is known by an inventor that most LCDs are backlight type LCDs and each LCD includes a liquid crystal panel and a backlight module. A working principle of the liquid crystal panel is to place liquid crystal molecules into two parallel glass substrates and apply a drive voltage onto the two glass substrates to control rotation directions of the liquid crystal molecules, thereby refracting light rays of the backlight module to generate a picture.

When the liquid crystal panel is just started, a Timing Controller Integrated Circuit (TCON IC) takes a certain time to read an external code and complete initial configuration settings of a register inside the IC, and as a matter of fact, an output of the TCON IC is in an unstable state during this period of time, so a condition of an abnormal startup screen is occurred easily. This is mainly solved by pushing a turn-on time of a backlight module back to some extent during just starting, i.e., when the TCON IC is unstable, the backlight module is not mined on first and then after the output of the TCON IC is stable, the backlight module is turned on. However, such a manner prolongs the starting time, resulting in a complaint of a user.

SUMMARY

An object of the present application provides a drive circuit, a display module driving method and a display module to solve an abnormal startup screen of a display panel.

The present invention provides a drive circuit, which includes:

a timing control chip, configured to detect whether initial configuration work is completely finished or not, and output a state signal if the initial configuration work is completely finished;

a control circuit, configured to receive the state signal, and output a ready signal according to the state signal; and a gate drive circuit, configured to receive the ready signal, and control, according to the ready signal, whether a display screen displays a picture or not.

Optionally, the control circuit includes a first resistor, a first Metal Oxide Semiconductor (MOS) tube and a second MOS tube; the second MOS tube is an N-type MOS tube; the first MOS tube is a P-type MOS tube;

the control circuit further includes a first level signal, a second level signal and a logic level signal;

a gate terminal of the first MOS tube is connected to the state signal, a source terminal of the first MOS tube is connected to the logic level voltage signal, and a drain terminal of the first MOS tube is connected to the first level signal via the first resistor;

a gate terminal of the second MOS tube is connected between the drain terminal of the first MOS tube and the first resistor, a source terminal of the second MOS tube is connected to the first level signal, and a drain terminal of the second MOS tube is connected to a display panel; and when the state signal is the first level signal, the first MOS tube is connected; the gate terminal of the second MOS tube is pulled up by the logic level signal to the second level signal and is connected; and the ready signal outputs the first level signal to take as an output signal of the control circuit to output to the gate drive circuit.

Optionally, the control circuit further includes a second resistor, a third resistor, a third MOS tube and a fourth MOS tube; the third MOS tube is an N-type MOS tube; the fourth MOS tube is a P-type MOS tube;

a gate terminal of the third MOS tube is connected to the state signal and the gate terminal of the first MOS tube, a source terminal of the third MOS tube is connected to a ground terminal, and a drain terminal of the third MOS tube is connected to the second level signal sequentially via the third resistor and the second resistor;

a gate terminal of the fourth MOS tube is connected to the drain terminal of the third MOS tube via the third resistor, a source terminal of the fourth MOS tube is connected to the second level signal, and a drain terminal of the fourth MOS tube is connected to the display panel; and when the state signal outputs the second level signal, the first MOS tube is disconnected; meanwhile, the third MOS tube is connected; the gate terminal of the fourth MOS tube is pulled down by the ground terminal and is connected; and the ready signal outputs the second level signal to take as a control signal of the control circuit to output to the gate drive circuit.

The present application further discloses a display module driving method, which includes:

performing, by a timing control chip, initial configurations;

detecting, by the timing control chip, whether initial configuration work is completely finished or not, and outputting a state signal after the initial configuration work is completely finished; and controlling, according to the state signal, whether a display screen of a display panel displays a picture or not.

Optionally, after the display panel is started, a step of turning on a backlight module of a display module and the step of performing, by a timing control chip, initial configurations are performed simultaneously, so that the time is further saved.

Optionally, the timing control chip outputs the state signal to a gate drive circuit of the display screen of the display panel, thereby controlling whether the display screen of the display panel displays the picture or not.

Optionally, the display panel further includes a control circuit; the control circuit detects a state of the timing control chip, and outputs a ready signal to the display screen;

the step of outputting, by the timing control chip, a state signal includes:

when the timing control chip is in a code reading and configuration process, rolling to output, by the tuning control chip, a state signal of a first level signal to the control circuit; and after the timing control chip finishes all code configurations, outputting, by the timing control chip, a state signal of a second level signal to the control circuit;

the step of controlling whether a display screen of a display panel displays a picture or not includes:

when it is detected that the state signal output by the timing control chip is the first level signal, outputting the first level signal to the display screen; and when the state signal received by the control circuit is the second level signal, outputting, by the control circuit, the second level signal.

Optionally, the step of outputting, by the timing control chip, the state signal to the control circuit according to an initial configuration state includes:

when the timing control chip does not finish the configurations, outputting, by the timing control chip, the first level signal to take as the state signal to send to the control circuit; and when the timing control chip finishes all configurations, outputting, by the timing control chip, the second level signal to take as the state signal to send to the control circuit.

The present application further discloses a display module using the above-mentioned driving method, which includes:

a display screen;

a drive circuit, electrically connected with the display screen; and a backlight module, configured to provide a backlight source for the display screen;

where, the drive circuit includes:

a timing control chip; and a control circuit, electrically connected with the tinning control chip, and configured to output, according to an initial configuration state of the timing control chip, a state signal to the display screen on whether to display a picture or not.

Optionally, the backlight module includes a backlight source and a light source drive circuit; and when the display panel is started, while the light source drive circuit is turned on, the timing control chip performs initial configurations.

Optionally, the display screen includes a gate drive circuit; the control circuit outputs the state signal to the gate drive circuit of the display screen to control picture display of the display panel; and the timing control chip reads an initial code, configures the initial code, and outputs the state signal according to a configuration state of the initial code.

Compared with a solution in which a turn-on time of a backlight module is pushed back to some extent during just starting, i.e., when the TCON IC is unstable, the backlight module is not turned on first, and then after an output of the TCON IC is stable, the backlight module is turned on, in the present application, when the display panel is started, the timing control chip performs the initial configurations; and meanwhile, the backlight module is turned on, one state signal is output in the timing control chip, and the picture display of the display panel is controlled according to the state signal; therefore, the effect that the picture display of the display panel may be controlled when the timing control chip performs initialization is implemented, and a condition of the abnormal screen due to the fact that a picture is already opened when the tuning control chip hasn't finished all configurations is prevented.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
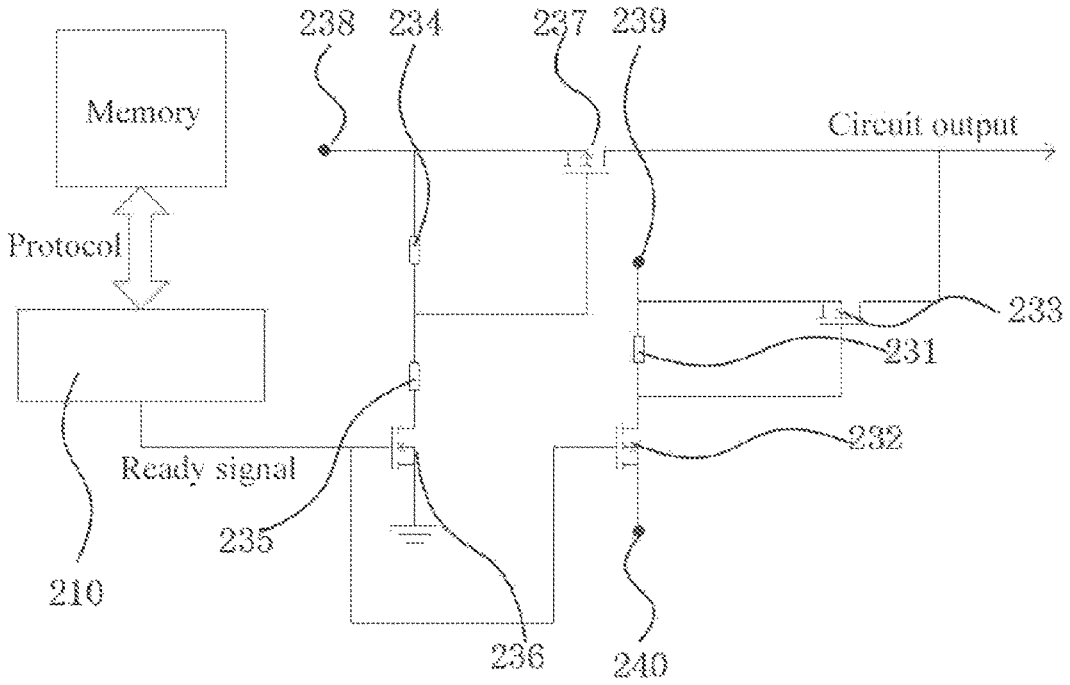
FIG. 1 is a circuit schematic diagram of a control circuit in an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or coupled; or directly connected or indirectly connected through an intermediate medium, or in an internal communication between two elements. The specific meanings about the foregoing terms in the present application may, be understood by, those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application will be further described below in combination with the accompanying drawings and optional embodiments.

Figure 2:
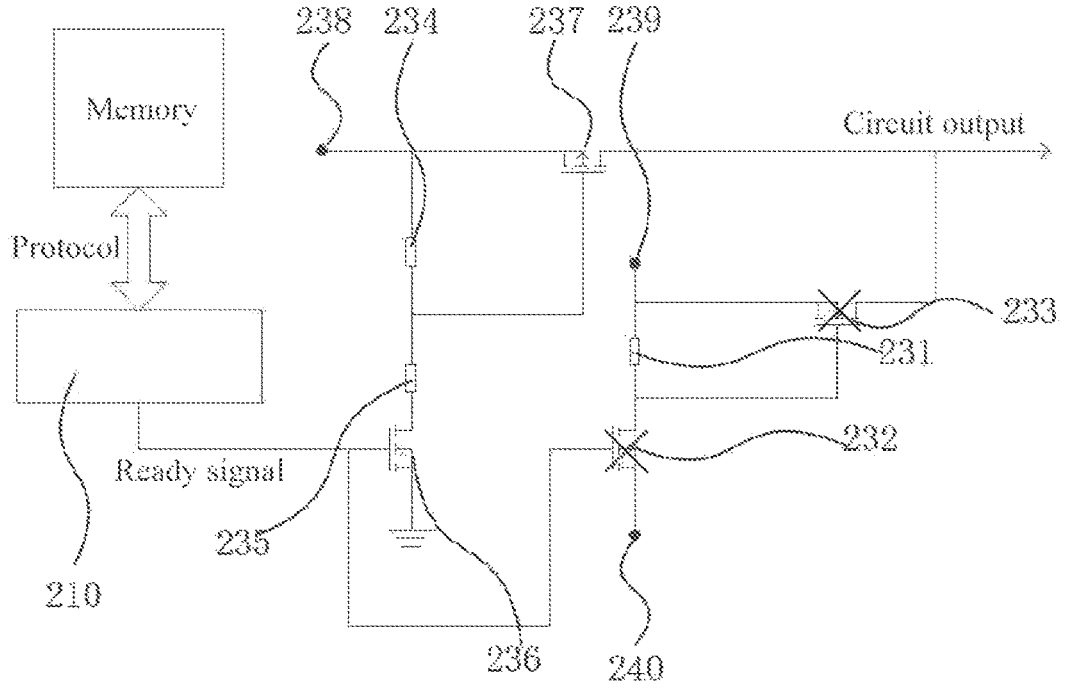
FIG. 2 is a circuit schematic diagram of a working state of a control circuit in an embodiment of the present application.
Figure 3:
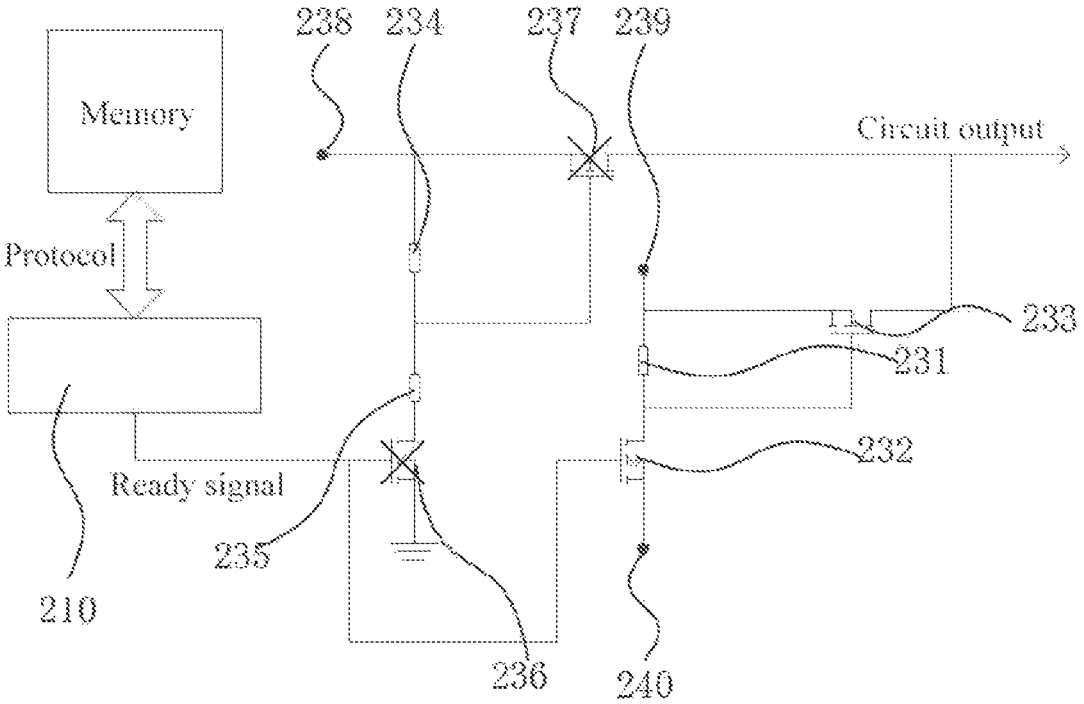
FIG. 3 is a circuit schematic diagram of another working state of a control circuit in an embodiment of the present application.
Figure 4:
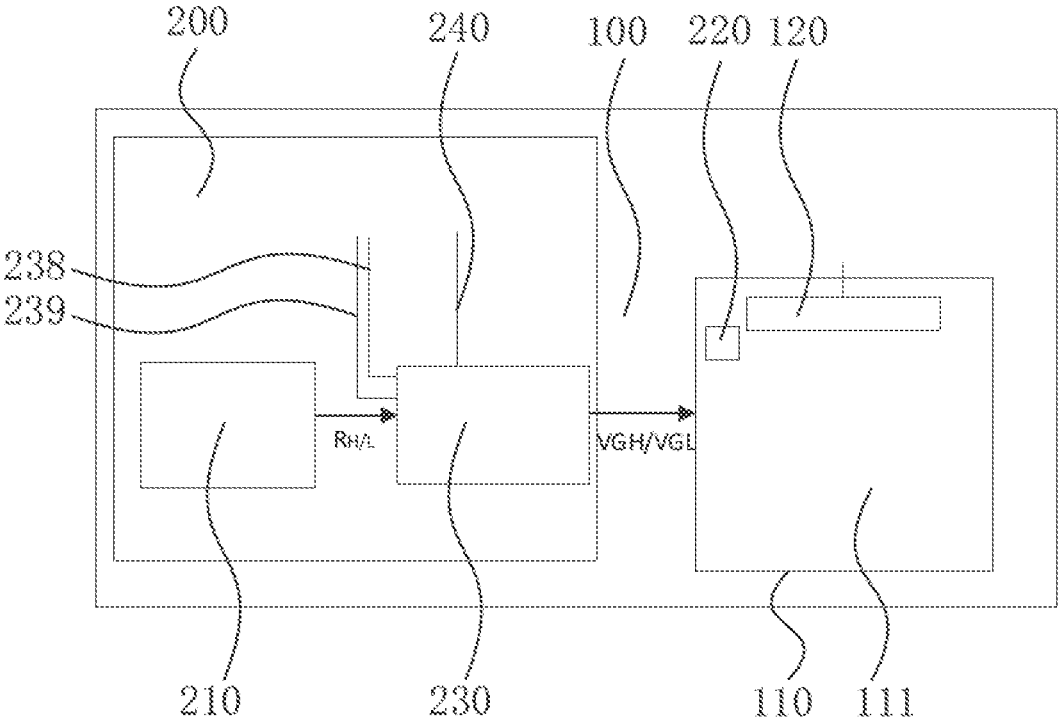
FIG. 4 is a schematic diagram of a display module in an embodiment of the present application.

As shown in FIG. 1 to FIG. 4, an embodiment of the present application discloses a drive circuit 200, which includes: a timing control chip 210, configured to detect whether initial configuration work is completely finished or not and output a state signal if the initial configuration work is completely finished; a control circuit 230, configured to receive the state signal, and output a ready signal according to the state signal; and a gate drive circuit 220, configured to receive the ready signal, and control, according to the ready signal, whether a display screen 111 displays a picture or not.

In this solution, when the display panel 110 is started, the timing control chip 210 performs the initial configurations; meanwhile, the backlight module 120 is turned on, one state signal is output in the timing control chip 210, and the picture display of the display panel 110 is controlled according to the state signal; therefore, the effect that the picture display of the display panel 110 may be controlled when the timing control chip 210 performs initialization is implemented, and a condition of an abnormal screen due to the fact that a picture is already opened when the timing control chip 210 hasn't finished all configurations is prevented.

In one embodiment, the control circuit 230 includes a first resistor 231, a first MOS tube 232 and a second MOS tube 233; the second MOS tube 233 is an N-type MOS tube; the first MOS tube 232 is a P-type MOS tube; the control circuit 230 further includes a first level signal 238, a second level signal 239 and a logic level signal 240; a gate terminal of the first MOS tube is connected to the state signal, a source terminal of the first MOS tube is connected to the logic level voltage signal, and a drain terminal of the first MOS tube is connected to the first level signal via the first resistor; a gate terminal of the second MOS tube is connected between the drain terminal of the first MOS tube and the first resistor 231, a source terminal of the second MOS tube is connected to the first level signal 238 and a drain terminal of the second MOS tube is connected to a display panel 110; when the state signal is the first level signal 238, the first MOS tube 232 is connected; the gate terminal of the second MOS tube 233 is pulled up by the logic level signal 240 to the second level signal 239 and is connected; and the ready signal outputs the first level signal 238 to take as an output signal of the control circuit 230 to output to the display panel 110.

In this solution, the second MOS tube 233 is the N-type MOS tube, the first MOS tube 232 is the P-type MOS tube, the N-type MOS tube is disconnected upon the reception of the first level signal 238 and the P-type MOS tube is connected upon the reception of the first level signal 238; the first MOS tube 232 receives the state signal first in the control circuit 230; when the timing control chip 210 sends out the state signal of the first level signal 238, the grid terminal of the first MOS tube 232 is connected upon the reception of the state signal of the first level signal 238, so that the logic level signal 240 is transmitted to the grid terminal of the second MOS tube 233; and moreover, since the logic level signal 240 is the second level signal 239, the second MOS tube 233 is connected. Therefore, the first level signal 238 connected to the source terminal of the second MOS tube 233 is transmitted to the gate drive circuit 220, and the gate drive circuit 220 controls the display panel 10 not to display.

In one embodiment, the control circuit 230 further includes a second resistor 234, a third resistor 235, a third MOS tube 236 and a fourth MOS tube 237; the third MOS tube 236 is an N-type MOS tube; the fourth MOS tube 237 is a P-type MOS tube; a gate terminal of the third MOS tube 236 is connected to the state signal and the gate terminal of the first MOS tube 232, a source terminal of the third MOS tube 236 is connected to a ground terminal, and a drain terminal of the third MOS tube 236 is connected to the second level signal 239 sequentially via the third resistor 235 and the second resistor 234; a gate terminal of the fourth MOS tube 237 is connected to the drain terminal of the third MOS tube 236 via the third resistor 235, a source terminal of the fourth MOS tube 237 is connected to the second level signal 239, and a drain terminal of the fourth MOS tube 237 is connected to the display panel 110; and when the state signal outputs the second level signal 239, the first MOS tube 232 is disconnected; meanwhile, the third MOS tube 236 is connected; the gate terminal of the fourth MOS tube 237 is pulled down by the ground terminal and is connected; and the ready signal outputs the second level signal 239 to take as an output signal of the control circuit 230 to output to the gate drive circuit 220.

In this solution, the third MOS tube 236 is the N-type MOS tube, the fourth MOS tube 237 is the P-type MOS tube, the N-type MOS tube is connected upon the reception of the second level signal 239 and the P-type MOS tube is disconnected upon the reception of the second level signal 239; the third MOS tube 236 and the first MOS tube 232 receive the state signal first in the control circuit 230; when the timing control chip 210 sends out the state signal of the second level signal 239, the grid terminal of the third MOS tube 236 is connected upon the reception of the state signal of the second level signal 239, so that a signal of the ground terminal is transmitted to the grid terminal of the fourth MOS tube 237; and moreover, since the signal of the ground terminal is the first level signal 238, the fourth MOS tube 237 is connected. Therefore, the second level signal 239 connected to the source terminal of the fourth MOS tube 237 is transmitted to the gate drive circuit 220, and the gate drive circuit 220 controls the display panel 10 to display upon the reception of the first level signal 238.

As another embodiment of the present application, referring to FIG. 1 to FIG. 4, the present application discloses a display module 100 driving method, which includes: a display panel 110 is started, and a backlight module 120 of a display module 100 is turned on; a timing control chip 210 performs initial configurations; the timing control chip 210 detects whether initial configuration work is completely finished or not, and outputs a state signal after the initial configuration work is completely finished; and whether a display screen of the display panel 110 displays a picture or not is controlled according to the state signal.

When the display panel 110 is started, the timing control chip 210 performs the initial configurations; meanwhile, the backlight module 120 is turned on, one state signal is output in the timing control chip 210, and the picture display of the display panel 110 is controlled according to the state signal; therefore, the effect that the picture display of the display panel 110 may be controlled when the timing control chip 210 performs initialization is implemented, and a condition of an abnormal screen due to the fact that a picture is already opened when the timing control chip 210 hasn't finished all configurations is prevented.

In one embodiment, after the display panel 110 is started, the step that the backlight module 120 of the display module 100 is turned on and the step that the timing control chip 210 performs the initial configurations are performed simultaneously, so that the time is further saved.

In this solution, when the display panel 110 is started, the step that the backlight module 120 of the display module 100 is turned on and the step that the timing control chip 210 performs the initial configurations are performed simultaneously. Since the two steps may be performed simultaneously, the operation of other programs is not interfered, and the time of turning on the display screen may further be reduced, thereby facilitating, the use of a user and saving the time that the user waits for startup.

In one embodiment, the timing control chip 210 outputs the state signal to a gate drive circuit of the display screen of the display panel 110, thereby controlling whether the display screen of the display panel 110 displays the picture or not.

In this solution, the timing control chip 210 outputs the state signal to the gate drive circuit 200 of the display screen of the display panel 110, and may control, according to the state signal, whether the display screen of the display panel 110 displays the picture or not, so the condition of the abnormal picture display of the display screen due to the fact that the configurations of the timing control chip 210 haven't been finished and the timing control chip 210 is unstable when the display panel 110 is started is prevented.

In one embodiment, the display panel 110 further includes a control circuit 230. The control circuit 230 detects a state of the timing control chip 210, and outputs a ready signal to the gate drive circuit. The step that the timing control chip 210 outputs a state signal includes: when the timing control chip 210 is in a code reading and configuration process, the timing control chip 210 controls to output a state signal of a first level signal 238 to the control circuit 230, and after the timing control chip 210 finishes all code configurations, the timing control chip 210 outputs a state signal of a second level signal 239 to the control circuit 230.

In this solution, the timing control chip 210 may output the state signal of the first level signal 238 according to an own configuration condition after the display panel is started and before the configurations are finished, and may further output the state signal of the second level signal 239 after all configurations are finished. Through a state of the state signal, the control circuit 230 is notified of a configuration condition of the timing control chip 210. Therefore, the display panel 11 may be controlled to perform different displays according to different states, and a condition that the backlight module is turned on in advance to see the abnormal startup screen and the like is prevented.

In one embodiment, the step that whether a display screen of a display panel displays a picture or not is controlled includes: when it is detected that the state signal output by the timing control chip 210 is the first level signal 238, the ready signal of the first level signal 238 is output to the display screen; and when the state signal received by the control circuit 230 is the second level signal 239, the control circuit 230 outputs the state signal of the second level signal. In this solution, the first level signal is a high level, the second level signal is a low level, the first level signal of the state signal is a high level RH, the second level signal of the state signal is an RL, the first level signal of the ready signal is a VGH and the second level signal of the ready signal is a VGL.

In this solution, when the state, signal received by the control circuit 230 is the first level signal 238, the control circuit 230 outputs the ready signal of the first level signal 238; and when the state signal received by the control circuit 230 is the second level signal 239, the control circuit 230 outputs the ready signal of the second level signal 239. In this way, the control circuit 230 may know a configuration state of the timing control chip 210 according to the state of the state signal; if the timing control chip 210 is in the configuration state and does not finish all configurations, the work of a data drive chip is disconnected; since a voltage difference between two ends of the liquid crystal panel is zero, the penetration of the light cannot be controlled and a black screen appears. As a result, even though the backlight module is turned on in advance, there is no phenomenon that the user sees the abnormal startup screen; and moreover, when the timing control chip 210 finishes the configurations, since the backlight module 120 is turned on early and completes the preparation, the picture display may be performed immediately as long as an output port of the data drive chip is restored by the control circuit 230, and thus the starting time is saved.

In one embodiment, the step that the timing control chip 210 outputs the state signal to the control circuit 230 according to an initial configuration state includes: when the timing control chip 210 does not finish the configurations, the timing control chip 210 outputs the first level signal 238 to take as the state signal to send to the control circuit 230.

In this solution, when the display panel 110 is started, the timing control chip 210 does not finish the initial configurations; and meanwhile, the timing control chip 210 correspondingly outputs the first level signal 238 according to a state that the initial configurations are unfinished to take as the state signal and then sends the state signal to the control circuit 230; with the judgment of MOS tubes in the control circuit 230, the first level signal 238 is output to the display panel 110; and after the display panel 110 receives the first level signal 238, the liquid crystal panel cannot be charged and the display panel 110 maintains the black screen display.

In one embodiment, the step that the timing control chip 210 outputs the state signal to the control circuit according to an initial configuration state includes: when the timing control chip 210 finishes all configurations, the timing control chip 210 outputs the second level signal 239 to take as the state signal to send to the control circuit 230.

In this solution, when the timing control chip 210 detects that the configurations of the initial code are finished, the timing control chip 210 correspondingly outputs the second level signal 239 according to a state that the initial configurations are finished to take as the state signal and then sends the state signal to the control circuit 230; with the judgment of MOS tubes in the control circuit 230, the second level signal 239 is output to the display panel 110; and after the gate drive circuit 220 receives the second level signal 239, the liquid crystal panel is charged and the display panel starts to normally display the picture.

Figure 5:
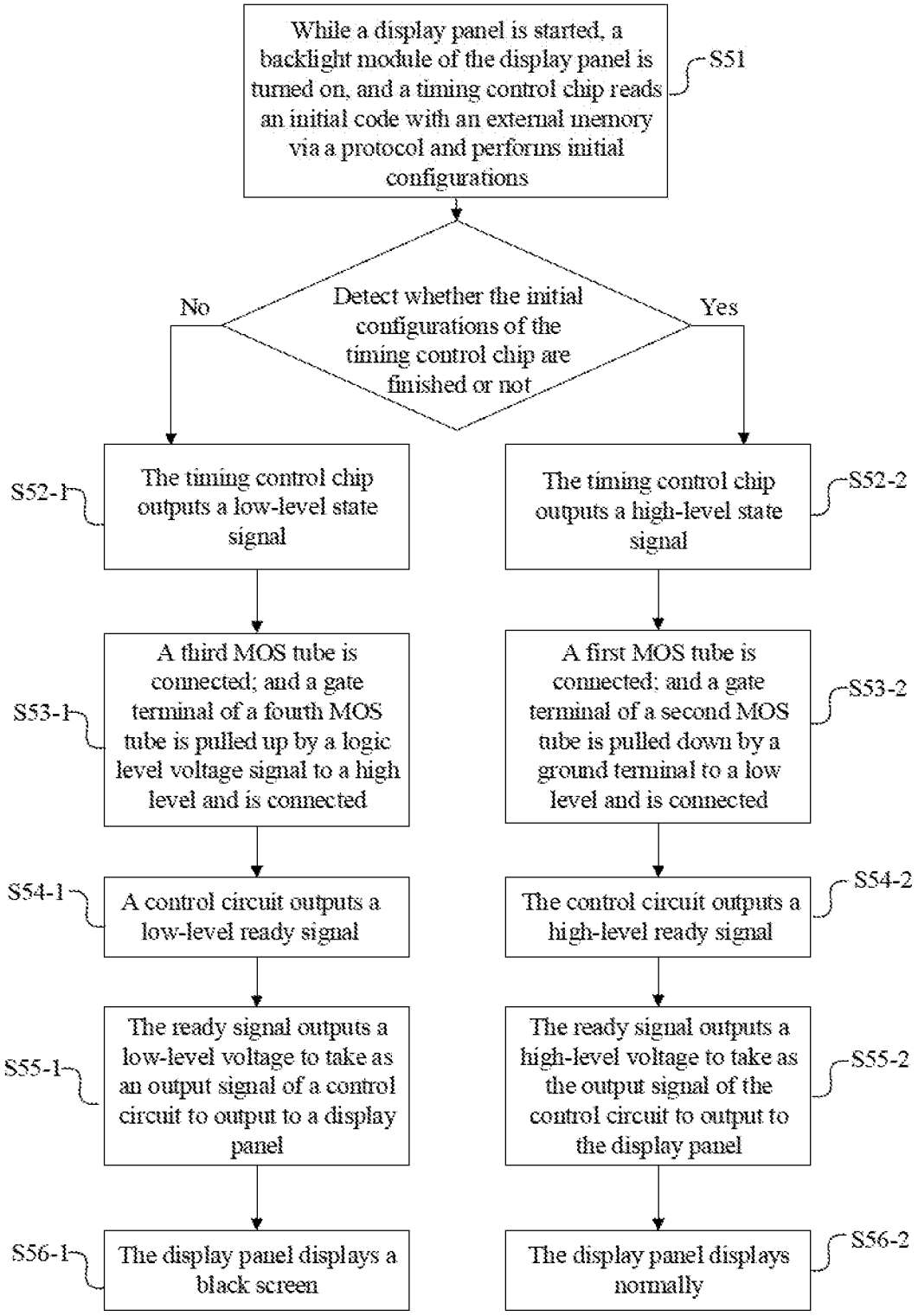
FIG. 5 is a flowchart schematic diagram of a display, module driving method in an embodiment of the present application.

As another embodiment of the present application, referring to FIG. 1 to FIG. 5, the present application discloses a display panel 110 driving method, which includes:

S51: A display panel 110 is started, and a timing control chip 210 reads an initial node with an external memory and configures the initial code.

S52-1: The timing control chip 210 detects that a configuration state of the initial code is unfinished, and the timing control chip 210 outputs a state signal of a first level signal 238 to the control circuit 230.

S53-1: A gate terminal of a first MOS tube 232 is connected to the state signal, a source terminal of the first MOS tube 232 is connected to a logic level signal 240, and a drain terminal of the first MOS tube 232 is connected to the first level signal 238 via a first resistor 141.

S54-1: A gate terminal of a second MOS tube 233 is connected between the drain terminal of the first MOS tube 232 and the first resistor 141, a source terminal of the second MOS tube 233 is connected to the first level signal 238, and a drain terminal of the second MOS tube 233 is connected to the display panel 110.

S55-1: When the state signal is the first level signal 238, the first MOS tube 232 is connected; the gate terminal of the second MOS tube is pulled up by the logic voltage level signal 240 to a second level signal 239 and is connected; and the state signal outputs the first level signal 238 to take as a ready signal of the control circuit 230 to output to a gate drive circuit 220.

S56-1: The gate drive circuit 220 receives the ready signal of the first level signal, and the gate drive circuit 220 controls the display panel 110 to display a black screen.

S52-2: The timing control chip 210 detects that the configuration state of the initial code is finished, and the timing control chip 210 outputs a state signal of the second level signal 239 to the control circuit 230.

S53-2: A gate terminal of a third MOS tube 236 is connected to the state signal and the gate terminal of the first MOS tube 232, a source terminal of the third MOS tube 236 is connected to a ground terminal, and a drain terminal of the third MOS tithe 236 is connected to the second level signal 239 sequentially via a third resistor 145 and a second resistor 144.

S54-2: A gate terminal of a fourth MOS tube 237 is connected to the drain terminal of the third MOS tube 236 via the third resistor 145, a source terminal of the fourth MOS tube 237 is connected to the second level signal 239, and a drain terminal of the fourth MOS tube 237 is connected to the gate drive circuit 220.

S55-2: When the state signal outputs the second level signal 239, the first MOS tube 232 is disconnected; meanwhile, the third MOS tube 236 is connected; the gate terminal of the fourth MOS tube 237 is pulled down by the ground terminal and is connected; and the ready signal outputs the second level signal 239 to take as a control signal of the control circuit 230 to output to the gate drive circuit 220 to control the display panel.

S56-2: The gate drive circuit 220 receives a ready signal of the second level signal, and the gate drive circuit 220 controls the display panel 110 to restore the display.

In this solution, the third MOS tube 236 and the second MOS tube 233 are, the N-type MOS tubes, the fourth MOS tube 237 and the first MOS tube 232 are the P-type MOS tubes, the N-type MOS tubes are disconnected upon the reception of the first level signal 238, and the P-type MOS tubes are connected upon the reception of the first level signal 238. The first MOS tube 232 receives the state signal first in the control circuit 230. When the display panel 110 is started, the timing control chip 210 reads the initial code with the external memory via a protocol and performs the initial configurations; when the timing control chip 210 detects that the configuration state of the initial code is unfinished, the state signal of the first level signal 238 is sent out, and the grid terminal of the first MOS tube 232 is connected upon the reception of the state signal of the first level signal 238, so that the logic level signal 240 is transmitted to the grid terminal of the second MOS tube 233; and moreover, the logic level signal 240 is the second level signal 239, the second MOS tube 233 is connected. Therefore, the first level signal 238 connected to the source terminal of the second MOS tube 233 is transmitted to the gate drive circuit 220, and after the gate drive circuit 220 receives the first level signal 238, the display panel does not display. The third MOS tube 236 and the first MOS tube 232 receive the state signal first in the control circuit 230. When the display panel 110 is started, the timing control chip 210 reads the initial code with the external memory via the protocol and performs the initial configurations; when the timing control chip 210 detects that the configuration state of the initial code is finished, the state signal of the second level signal 239 is sent out, and the grid terminal of the third MOS tribe is connected upon the reception of the state signal of the second level signal 239, so that a signal of the ground terminal is transmitted to the grid terminal of the fourth MOS tube 237; and moreover, the signal of the ground signal is the first level signal 238, the fourth MOS tube 237 is connected. Therefore, the second level signal 239 connected to the source terminal of the fourth MOS tube 237 is transmitted to the gate drive circuit 220, and after the gate drive circuit 220 receives the level signal 238, the display panel starts to display.

As another embodiment of the present application, referring to FIG. 1 to FIG. 4, the present application discloses a display module 100 using the above-mentioned driving method, which includes:

a display screen, a drive circuit 200 electrically connected with the display screen, and a backlight module 120 configured to provide a backlight source for the display screen, wherein the drive circuit 200 includes: a timing control circuit 210, and a control circuit 230 electrically connected with the timing control circuit 210 and configured to output, according to an initial configuration state of the timing control chip 210, a ready signal to the display screen on whether to display a picture.

In this solution, when the display panel 110 is started, the timing control circuit 210 performs the initial configurations; meanwhile, a state signal is output in the timing control circuit 210 and is transmitted to the control circuit 230; and the control circuit 230 outputs the ready signal to a gate drive circuit of a display screen via internal control, thereby controlling the picture display of the display panel 110. In one embodiment, the backlight module 120 includes a backlight source and a light source drive circuit; and when the display panel 110 is started, while the light source drive circuit is turned on, the timing control chip 210 performs the initial configurations.

In this solution, when the display panel 110 is started, the step that the backlight source of the display module 100 is turned on and the step that the timing control chip 210 performs the initial configurations are performed simultaneously. Since the two steps may be performed simultaneously, the operation of other programs is not interfered, and the time of turning on the display screen may further be reduced, thereby facilitating the use of a user and saving the time that the user waits for starting up.

In one embodiment, the display screen includes a gate drive circuit; the control circuit 230 outputs the ready signal to the gate drive circuit of the display screen to control picture display of the display panel 110; and when the display panel 110 is started, the timing control chip 210 reads an initial code with an external memory, configures the initial code, and outputs the ready signal according to a configuration state of the initial code.

In this solution, the display screen is provided with the gate drive circuit to receive the ready signal output by the control circuit 230. The gate drive circuit controls the picture display of the display panel 110 upon the reception of the ready signal, and thus the abnormal screen due to the fact that the timing control chip 210 performs the initial configurations when the display panel 110 is started may be controlled.

It is to be noted that, the limit on each step related in this solution is not considered as a limit to a sequential order of the steps on the premise of not affecting implementation of a specific solution. A step written in front may be executed ahead and may also be executed later, or even may also be executed simultaneously; and as long as this solution can be implemented, all should be considered as a scope of protection of the present application.

In the present application, the panel may be a Twisted Nematic (TN) panel, an In-Plane Switching (IPS) panel, a Multi-domain Vertical Alignment (VA) panel, and of source, may also be other types of appropriate panels.

The above are further detailed descriptions of the present application in combination with specific optional implementation manners and should not be deemed as that the specific implementation of the present application is only limited to these descriptions. A person of ordinary skill in the art to which the present application belongs may further make a plurality of simple deviations or replacements without departing from the concept of the present application and all should be considered as the scope of protection of the present application.

What is claimed is:

1. A drive circuit, comprising:

a timing control chip, configured to detect whether initial configuration work is completely finished or not, and output a state signal depending on whether the initial configuration work has been completely finished;

a control circuit, configured to receive the state signal, and output a ready signal according to the state signal; and a gate drive circuit, configured to receive the ready signal, and control, according to the ready signal, whether a display screen displays a picture or not;

wherein the control circuit comprises a first resistor, a first Metal Oxide Semiconductor (MOS) tube and a second MOS tube; the second MOS tube is an N-type MOS tube; the first MOS tube is a P-type MOS tube;

the control circuit further comprises a first level signal, a second level signal and a logic level signal;

a gate terminal of the first MOS tube is connected to the state signal, a source terminal of the first MOS tube is connected to the logic level voltage signal, and a drain terminal of the first MOS tube is connected to the first level signal via the first resistor;

a gate terminal of the second MOS tube is connected between the drain terminal of the first MOS tube and the first resistor, a source terminal of the second MOS tube is connected to the first level signal, and a drain terminal of the second MOS tube is connected to a display panel; and when the state signal is the first level signal, the first MOS tube is turned on; the gate terminal of the second MOS tube is pulled up by the logic level signal to the second level signal and is turned on; and the control circuit outputs the first level signal as the ready signal to the gate drive circuit.

2. The drive circuit according to claim 1, wherein the control circuit further comprises a second resistor, a third resistor, a third MOS tube and a fourth MOS tube; the third MOS tube is an N-type MOS tube; the fourth MOS tube is a P-type MOS tube;

a gate terminal of the third MOS tube is connected to the state signal and the gate terminal of the first MOS tube, a source terminal of the third MOS tube is connected to a ground terminal, and a drain terminal of the third MOS tube is connected to the second level signal sequentially via the third resistor and the second resistor;

a gate terminal of the fourth MOS tube is connected to the drain terminal of the third MOS tube via the third resistor, a source terminal of the fourth MOS tube is connected to the second level signal, and a drain terminal of the fourth MOS tube is connected to the display panel; and when the state signal outputs the second level signal, the first MOS tube is turned off; meanwhile, the third MOS tube is connected; the gate terminal of the fourth MOS tube is pulled down by the ground terminal and is turned on; and the control circuit outputs the second level signal as the ready signal to the gate drive circuit.

3. A driving method of driving a display panel by a drive circuit, the display panel comprising: a display screen, the drive circuit comprising a timing control chip configured to detect whether initial configuration work is completely finished or not and output a state signal depending on whether the initial configuration work has been completely finished; a control circuit configured to receive the state signal and output a ready signal according to the state signal; and a gate drive circuit configured to receive the ready signal and control whether the display screen displays a picture or not according to the ready signal;

wherein the control circuit comprises a first resistor, a first Metal Oxide Semiconductor (MOS) tube and a second MOS tube; the second MOS tube is an N-type MOS tube; the first MOS tube is a P-type MOS tube; the control circuit further comprises a first level signal a second level signal and a logic level signal; a gate terminal of the first MOS tube is connected to the state signal, a source terminal of the first MOS tube is connected to the logic level voltage signal, and a drain terminal of the first MOS tube is connected to the first level signal via the first resistor; a gate terminal of the second MOS tube is connected between the drain terminal of the first MOS tube and the first resistor, a source terminal of the second MOS tube is connected to the first level signal, and a drain terminal of the second MOS tube is connected to a display panel; and wherein when the state signal is the first level signal, the first MOS tube is turned on, and the gate terminal of the second MOS tube is pulled up by the logic level signal to the second level signal and is turned on, and the control circuit outputs the first level signal as the ready signal to the gate drive circuit:

wherein the driving method comprises:

starting the display panel;

performing, by the timing control chip, initial configurations;

detecting, by the timing control chip, whether the initial configuration work is completely finished or not, and outputting a state signal depending on whether the initial configuration work has been completely finished; and controlling, according to the state signal, whether the display screen of the display panel displays a picture or not.

4. The display module driving method according to claim 3, wherein after the display panel is started, a step of turning on a backlight module of a display module and the step of performing, by a timing control chip, initial configurations are performed simultaneously.

5. The display module driving, method according to claim 3, wherein the operation of performing, by the tuning control chip, initial configurations comprises a code reading and configuration process, and wherein the step of outputting, by the timing control chip, a state signal comprises:

when the timing control chip is in the code reading and configuration process, controlling to output, by the timing control chip, the first level signal as the state signal to the control circuit.

6. The display module driving method according to claim 3, wherein the step of outputting, by the timing control chip, a state signal comprises:

after the timing control chip finishes all code configurations, outputting, by the timing control chip, the second level signal as the state signal to the control circuit.

7. The display module driving method according to claim 3, wherein the state signal comprises a first level signal and a second level signal, and wherein the step of controlling whether a display screen of a display panel displays a picture or not comprises:

in response to the state signal output by the timing control chip and received by the control circuit being the first level signal, outputting the first level signal to the gate drive circuit to drive the display screen; and in response to the state signal output by the timing control chip and received by the control circuit being the second level signal, outputting, by the control circuit, the second level signal to the gate drive circuit to drive the display screen.

8. The display module driving method according to claim 3, wherein the display panel further comprises a control circuit configured to receive the state signal output from the timing control chip and output a ready signal to the gate drive circuit according to the state signal, wherein the state signal comprises a first level signal and a second level signal, and wherein when the timing control chip does not yet finish the initial configuration work, outputting, by the timing control chip, the first level signal as the state signal to the control circuit.

9. The display module driving method according to claim 3, wherein the display panel further comprises a control circuit configured to receive the state signal output from the timing control chip and output a ready signal to the gate drive circuit according to the state signal, wherein the state signal comprises a first level signal and a second level signal, and wherein when the timing control chip has finished all configurations, outputting, by the timing control chip, the second level signal as the state signal to the control circuit.

10. A display module, comprising:

a display screen;

a drive circuit, electrically connected with the display screen; and a backlight module, configured to provide a backlight source for the display screen;

wherein the drive circuit comprises:

a timing control chip, configured to detect whether initial configuration work is completely finished or not, and output a state signal depending on whether the initial configuration work has been completely finished; and a control circuit, electrically connected with the timing control chip, and configured to receive the state signal and output a ready signal to the display screen according to the state signal to control Whether to display a picture or not; wherein the control circuit comprises a first resistor, a first Metal Oxide Semiconductor (MOS) tube and a second MOS tube; the second MOS tube is an N-type MOS tube; the first MOS tube is a P-type MOS tube;

the control circuit further comprises a first level signal, a second level signal and a logic level signal;

a gate terminal of the first MOS tube is connected to the state signal, a source terminal of the first MOS tube is connected to the logic level voltage signal, and a drain terminal of the first MOS tube is connected to the first level signal via the first resistor;

a gate terminal of the second MOS tube is connected between the drain terminal of the first MOS tube and the first resistor, a source terminal of the second MOS tube is connected to the first level signal, and a drain terminal of the second MOS tube is connected to the display panel; and when the state signal is the first level signal, the first MOS tube is turned on; the gate terminal of the second MOS tube is pulled up by the logic level signal to a second level signal and is turned on; and the control circuit outputs the first level signal as the ready signal to the gate drive circuit.

11. The display module according to claim 10, wherein the backlight module comprises a backlight source and a light source drive circuit; and when the display module is started, the light source drive circuit is turned on simultaneously as the timing control chip starts performing the initial configurations.

12. The display module according to claim 10, wherein the display screen comprises a gate drive circuit; the control circuit outputs the ready signal to the gate drive circuit of the display screen to control picture display of the display panel; and the timing control chip reads an initial code, configures the initial code, and outputs a state signal according to a configuration state of the initial code.

13. The display module according to claim 10, wherein the control circuit further comprises a second resistor, a third resistor, a third MOS tube and a fourth MOS tube; the third MOS tube is an N-type MOS tube; the fourth MOS tube is a P-type MOS tube;

a gate terminal of the third MOS tube is connected to the state signal and the gate terminal of the first MOS tube, a source terminal of the third MOS tube is connected to a ground terminal, and a drain terminal of the third MOS tube is connected to the second level signal sequentially via the third resistor and the second resistor;

a gate terminal of the fourth MOS tube is connected to the drain terminal of the third MOS tube via the third resistor, a source terminal of the fourth MOS tube is connected to the second level signal, and a drain terminal of the fourth MOS tube is connected to the display panel; and when the state signal outputs the second level signal, the first MOS tube is disconnected; meanwhile, the third MOS tube is connected; the gate terminal of the fourth MOS tube is pulled down by the ground terminal and is connected; and the ready signal outputs the second level signal to take as a control signal of the control circuit to output to the gate chive circuit.

* * * * *